US007445167B1

(12) United States Patent
Chen

(10) Patent No.: US 7,445,167 B1
(45) Date of Patent: Nov. 4, 2008

(54) SPRAYING GUN FOR WASHING CAR

(75) Inventor: Chin-Yuan Chen, Changhua Hsien (TW)

(73) Assignee: Shin Tai Spurt Water of the Garden Tools Co., Ltd., Changhua Hsien (TW)

( * ) Notice: Subject to any disclaimer, the term of this patent is extended or adjusted under 35 U.S.C. 154(b) by 32 days.

(21) Appl. No.: 11/651,886

(22) Filed: Jan. 10, 2007

(51) Int. Cl.
*B05B 7/02* (2006.01)

(52) U.S. Cl. ..... 239/525; 239/310; 239/318; 239/526

(58) Field of Classification Search ..... 239/310, 239/318, 525, 526, 581.1
See application file for complete search history.

(56) References Cited

U.S. PATENT DOCUMENTS 2,460,545 A * 2/1949 Spreng ..... 239/480
3,770,205 A * 11/1973 Proctor et al. ..... 239/317
4,491,254 A * 1/1985 Viets et al. ..... 222/83.5
4,653,691 A * 3/1987 Grime ..... 239/311
4,785,850 A * 11/1988 Sanchez ..... 137/894
5,669,558 A * 9/1997 Ichel ..... 239/311
6,402,053 B1 * 6/2002 Chih ..... 239/310
6,726,123 B2 * 4/2004 Wang ..... 239/310
7,322,534 B2 * 1/2008 Bartsch et al. ..... 239/310

* cited by examiner

*Primary Examiner*—Len Tran
*Assistant Examiner*—Trevor E. McGraw
(74) *Attorney, Agent, or Firm*—Alan Kamrath; Kamrath & Associates PA

(57) ABSTRACT

A spraying gun includes a gun body, a control valve, and a nozzle head. The control valve includes a valve body, an adjusting switch, a rotation knob, and a container. Thus, the water from the gun body is injected through the inlet flush hole of the valve body and the inlet flush bore of the adjusting switch into the receiving space of the container to stir and mix with the detergent, and the water and detergent mixture is injected through the outlet injection bore of the adjusting switch and the outlet injection hole of the valve body into the nozzle head, so that the water is mixed with the detergent in the container exactly and completely, thereby enhancing the washing effect of the spraying gun.

15 Claims, 7 Drawing Sheets

SPRAYING GUN FOR WASHING CAR

BACKGROUND OF THE INVENTION

1. Field of the Invention

The present invention relates to a spraying gun and, more particularly, to a spraying gun containing a detergent foe washing a car.

2. Description of the Related Art

A conventional spraying gun in accordance with the prior art shown in FIGS. 8 and 9 comprises a gun body 10 having a water outlet port 11, a control valve 30 mounted on the gun body 10, and a nozzle head 20 mounted on the control valve 30 and having a water inlet port 21 connected to the water outlet port 11 of the gun body 10 via the control valve 30. The control valve 30 includes a valve body 31, an adjusting switch 33, a rotation knob 32, and a container 34. The valve body 31 of the control valve 30 has a first end formed with a water inlet hole 311 connected to the water outlet port 11 of the gun body 10, a second end formed with a water outlet hole 312 connected to the water inlet port 21 of the nozzle head 20 and a mediate portion formed with a valve chamber 313 connected between the water inlet hole 311 and the water outlet hole 312. The valve body 31 of the control valve 30 has a first side formed with a mounting portion 315 having an outlet injection hole 316 connected to the water outlet hole 312 and a second side formed with a mounting groove 314 connected to the valve chamber 313. The adjusting switch 33 of the control valve 30 is rotatably mounted in the valve body 31 and includes a stop disk 336 having an outlet injection bore 337 that is movable to connect to the outlet injection hole 316 of the valve body 31, and a control stem 331 mounted in the valve chamber 313 of the valve body 31 and having a first side formed with a seal portion 332 that is movable to interrupt a connection between the water inlet hole 311 and the water outlet hole 312 of the valve body 31 and a second side formed with a conducting portion 333 that is movable to open the connection between the water inlet hole 311 and the water outlet hole 312 of the valve body 31. The control stem 331 of the adjusting switch 33 is secured on the stop disk 336 and has a lower end formed with a water outlet bore 335 connected to container 34. The control stem 331 of the adjusting switch 33 has a peripheral wall formed with a water inlet bore 334 connected to the water outlet bore 335 movable to connect to the water inlet hole 311 of the valve body 31. The rotation knob 32 of the control valve 30 is rotatably mounted in the mounting groove 314 of the valve body 31 and secured to the control stem 331 of the adjusting switch 33 to rotate the adjusting switch 33. The container 34 of the control valve 30 contains detergent therein and has a top formed with a mounting section 341 mounted in the mounting portion 315 of the valve body 31.

In operation, when the rotation knob 32 is rotated, the adjusting switch 33 is rotatable to a position where the seal portion 332 of the adjusting switch 33 aligns with and seal the water inlet hole 311 of the valve body 31 to interrupt the connection between the water inlet hole 311 and the water outlet hole 312 of the valve body 31, so that the water from the water outlet port 11 of the gun body 10 is stopped. At this time, the water inlet bore 334 of the adjusting switch 33 is separated from the water inlet hole 311 of the valve body 31, so that the water from the water outlet port 11 of the gun body 10 cannot flow into the container 34. When the adjusting switch 33 is rotatable to a position where the conducting portion 333 of the adjusting switch 33 aligns with the water inlet hole 311 of the valve body 31 to open the connection between the water inlet hole 311 and the water outlet hole 312 of the valve body 31, the water from the water outlet port 11 of the gun body 10 can in turn flow through the water inlet hole 311 of the valve body 31, the conducting portion 333 of the adjusting switch 33, the water outlet hole 312 of the valve body 31 and the water inlet port 21 of the nozzle head 20 into the nozzle head 20. Thus, the water is sprayed outwardly from the nozzle head 20 for use with a user. At this time, the water inlet bore 334 of the adjusting switch 33 aligns with the water inlet hole 311 of the valve body 31, so that the water from the water outlet port 11 of the gun body 10 can flow through the water inlet hole 311 of the valve body 31, the conducting portion 333 of the adjusting switch 33, the water inlet bore 334 of the adjusting switch 33 and the water outlet bore 335 of the adjusting switch 33 into the container 34 as shown in FIG. 9 to mix with the detergent contained in the container 34. Then, the water and detergent mixture from the container 34 can in turn flow through the outlet injection bore 337 of the adjusting switch 33, the outlet injection hole 316 of the valve body 31, the water outlet hole 312 of the valve body 31 and the water inlet port 21 of the nozzle head 20 into the nozzle head 20 as shown in FIG. 9. Thus, the water and detergent mixture is sprayed outwardly from the nozzle head 20 for use with the user.

However, the water from the water outlet bore 335 of the adjusting switch 33 into the container 34 cannot completely stir the detergent contained in the container 34, so that the water only mixes with a partial detergent contained in the container 34 and dos not use all of the detergent contained in the container 34, thereby decreasing the washing effect of the spraying gun.

BRIEF SUMMARY OF THE INVENTION

In accordance with the present invention, there is provided a spraying gun, comprising a gun body having a water outlet port, a control valve mounted on the gun body, and a nozzle head mounted on the control valve and having a water inlet port connected to the water outlet port of the gun body via the control valve. The control valve includes a valve body, an adjusting switch, a rotation knob, and a container. The valve body of the control valve has a first end formed with a water inlet hole connected to the water outlet port of the gun body, a second end formed with a water outlet hole connected to the water inlet port of the nozzle head and a mediate portion formed with a valve chamber connected between the water inlet hole and the water outlet hole. The valve body of the control valve has a first side formed with a hollow mounting portion having an inlet flush hole connected to the water inlet hole and an outlet injection hole connected to the water outlet hole. The adjusting switch of the control valve is rotatably mounted in the valve body and includes a stop disk having an inlet flush bore that is movable to connect to the inlet flush hole of the mounting portion of the valve body and an outlet injection bore that is movable to connect to the outlet injection hole of the mounting portion of the valve body. The rotation knob of the control valve is rotatably mounted on the valve body and secured to the adjusting switch to rotate the adjusting switch. The container of the control valve is mounted on the valve body and has an inside formed with a receiving space connected to the inlet flush bore and the outlet injection bore of the adjusting switch.

The primary objective of the present invention is to provide a spraying gun, wherein the water is injected through the inlet flush hole of the valve body and the inlet flush bore of the adjusting switch into the receiving space of the container to stir and mix with the detergent, and the water and detergent mixture is injected through the outlet injection bore of the adjusting switch and the outlet injection hole of the valve body into the nozzle head, so that the water is mixed with the detergent in the container exactly and completely, thereby enhancing the washing effect of the spraying gun.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
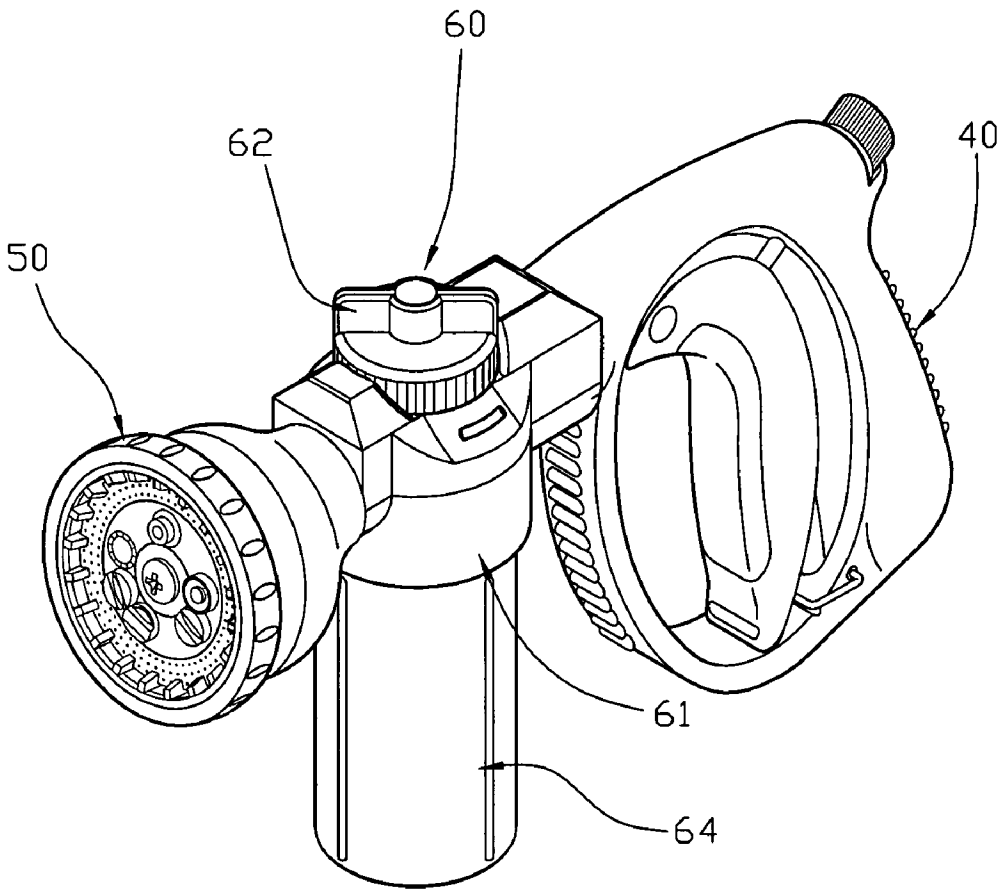
FIG. 1 is a perspective view of a spraying gun in accordance with the preferred embodiment of the present invention.
Figures 2, 2A:
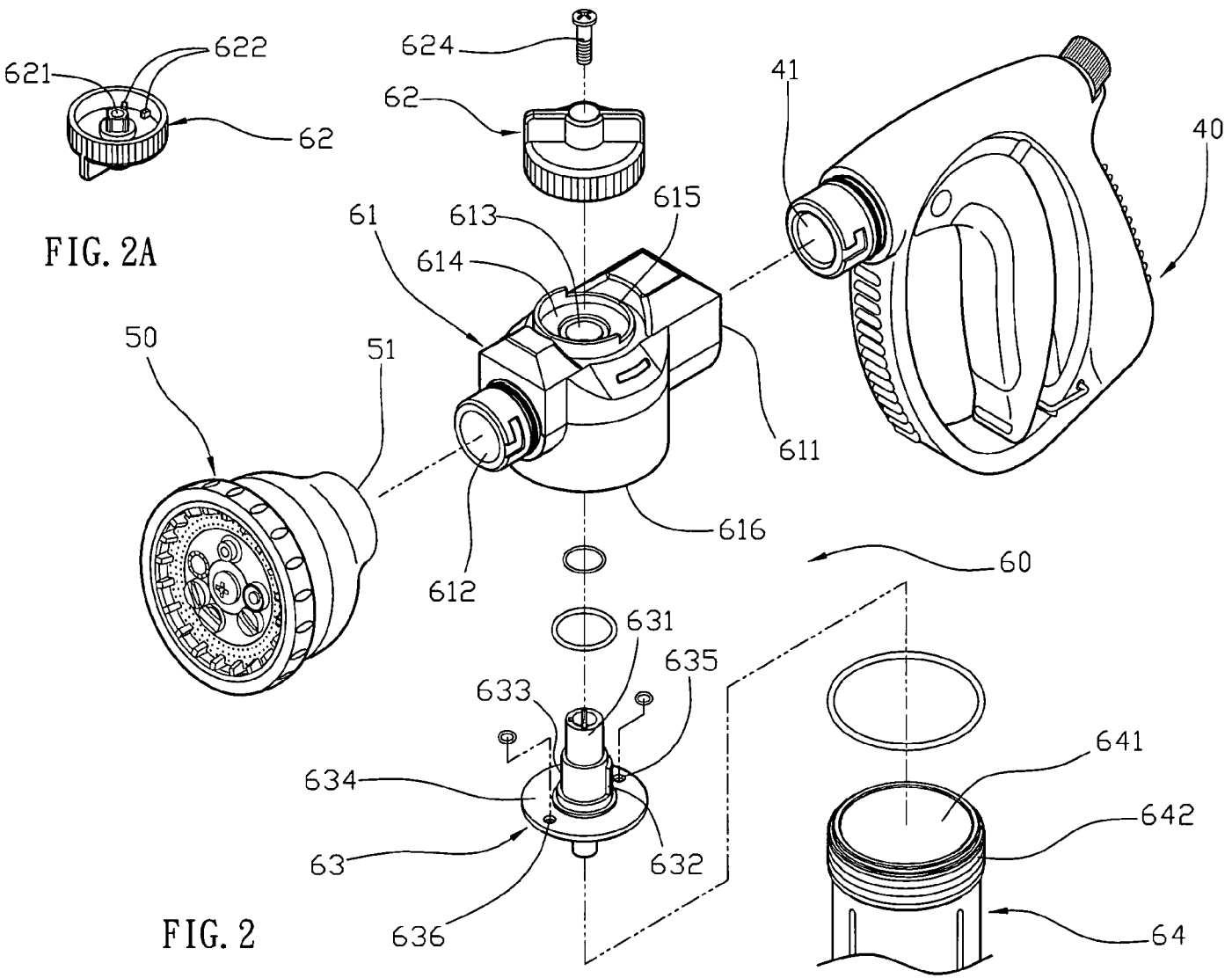
FIG. 2 is an exploded perspective view of the spraying gun as shown in FIG. 1.
FIG. 2A is a bottom perspective view of a rotation knob of the spraying gun as shown in FIG. 2.
Figure 3:
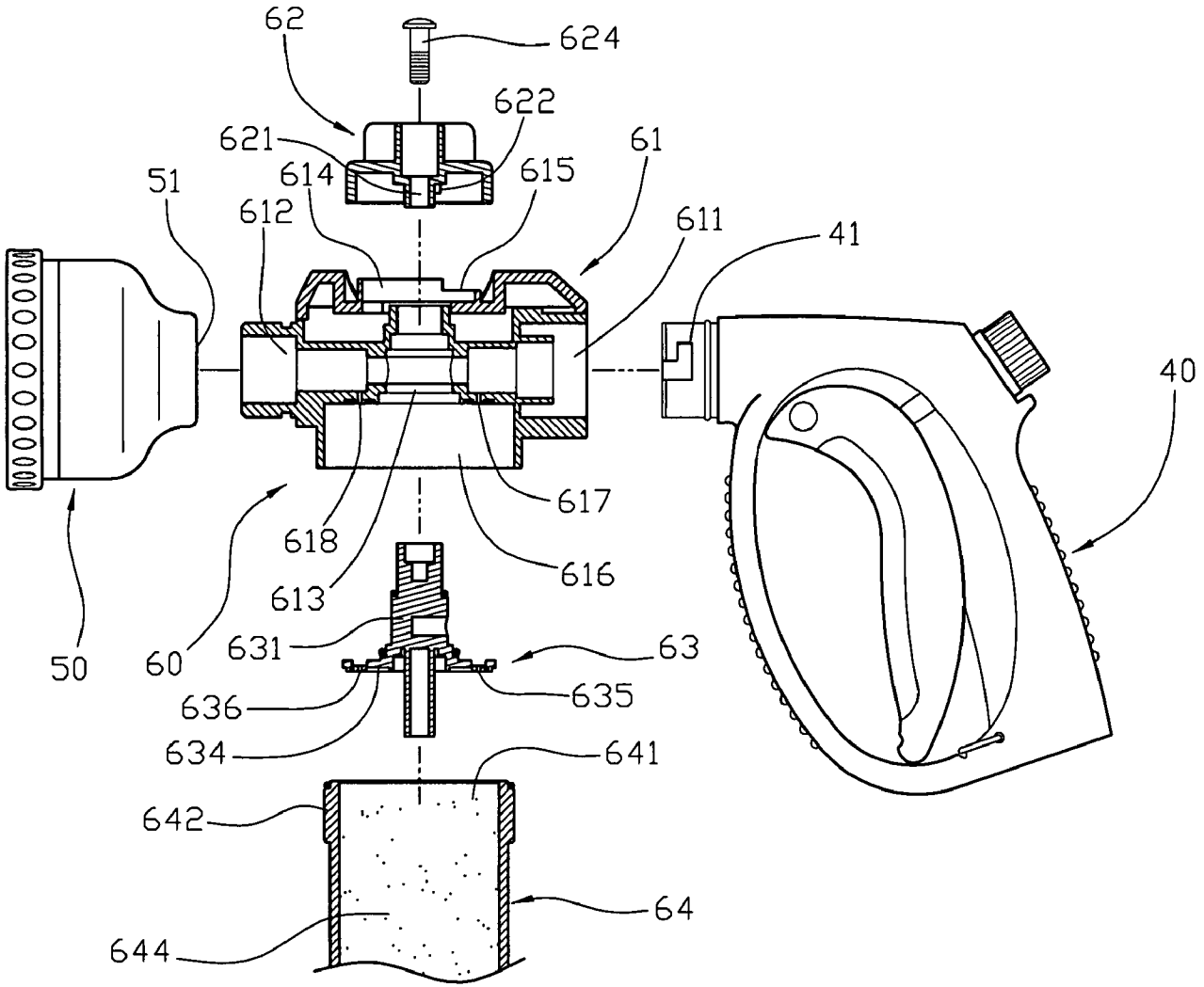
FIG. 3 is a side cross-sectional view of the spraying gun as shown in FIG. 2.

Referring to the drawings and initially to FIGS. 1-5, a spraying gun in accordance with the preferred embodiment of the present invention comprises a gun body 40 having a water outlet port 41, a control valve 60 mounted on the gun body 40, and a nozzle head 50 mounted on the control valve 60 and having a water inlet port 51 connected to the water outlet port 41 of the gun body 40 via the control valve 60.

The control valve 60 includes a valve body 61, an adjusting switch 63, a rotation knob 62, and a container 64.

The valve body 61 of the control valve 60 has a first end formed with a water inlet hole 611 connected to the water outlet port 41 of the gun body 40, a second end formed with a water outlet hole 612 connected to the water inlet port 51 of the nozzle head 50 and a mediate portion formed with a valve chamber 613 connected between the water inlet hole 611 and the water outlet hole 612. The valve body 61 of the control valve 60 has a first side formed with a hollow mounting portion 616 having an inlet flush hole 617 connected to the water inlet hole 611 and an outlet injection hole 618 connected to the water outlet hole 612 and has a second side formed with a mounting groove 614 connected to the valve chamber 613. The mounting portion 616 of the valve body 61 is connected to the valve chamber 613 which is located between the inlet flush hole 617 and the outlet injection hole 618. Each of the inlet flush hole 617 and the outlet injection hole 618 is formed in a peripheral wall of the mounting portion 616 of the valve body 61. The mounting groove 614 of the valve body 61 has a peripheral wall formed with a substantially arc-shaped recessed limit portion 615.

The adjusting switch 63 of the control valve 60 is rotatably mounted in the valve body 61 and includes a stop disk 634 having an inlet flush bore 635 that is movable to connect to the inlet flush hole 617 of the mounting portion 616 of the valve body 61 and an outlet injection bore 636 that is movable to connect to the outlet injection hole 618 of the mounting portion 616 of the valve body 61, and a control stem 631 mounted in the valve chamber 613 of the valve body 61 and having a first side formed with a substantially arc-shaped protruding seal portion 632 that is movable to interrupt a connection between the water inlet hole 611 and the water outlet hole 612 of the valve body 61 and a second side formed with a substantially arc-shaped recessed conducting portion 633 that is movable to open the connection between the water inlet hole 611 and the water outlet hole 612 of the valve body 61. The stop disk 634 of the adjusting switch 63 is located between the valve chamber 613 and the mounting portion 616 of the valve body 61 to interrupt a connection between the valve chamber 613 and the mounting portion 616 of the valve body 61. The control stem 631 of the adjusting switch 63 is rotatably mounted in the valve chamber 613 of the valve body 61 and has a first end secured on the stop disk 634 and a second end protruded outwardly from the valve chamber 613 of the valve body 61.

The rotation knob 62 of the control valve 60 is rotatably mounted on the valve body 61 and secured to the control stem 631 of the adjusting switch 63 to rotate the adjusting switch 63. The rotation knob 62 of the control valve 60 is rotatably mounted in the mounting groove 614 of the valve body 61 and has an inside formed with an outwardly protruding connecting portion 621 secured to the second end of the control stem 631 of the adjusting switch 63 by a locking screw 624. The rotation knob 62 of the control valve 60 has a peripheral wall formed with a stop portion 622 (see FIG. 2A) that is movable in and limited by the limit portion 615 of the valve body 61 to limit a rotation angle of the adjusting switch 63.

The container 64 of the control valve 60 is mounted on the valve body 61 and has an inside formed with a receiving space 641 containing detergent 644 therein and connected to the inlet flush bore 635 and the outlet injection bore 636 of the adjusting switch 63. The container 64 of the control valve 60 has an open top formed with a mounting section 642 mounted in the mounting portion 616 of the valve body 61.

Figure 4:
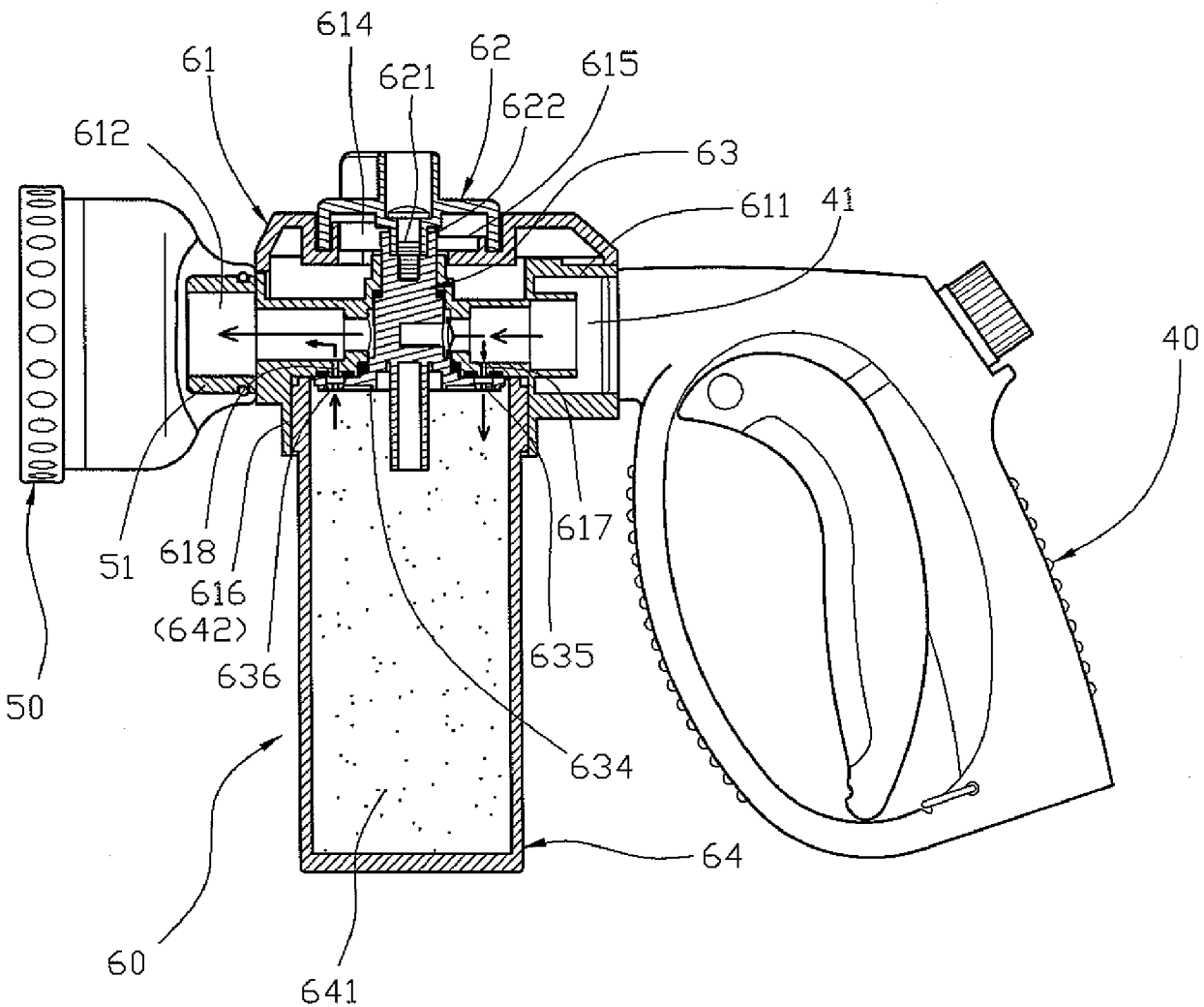
FIG. 4 is a side cross-sectional view of the spraying gun as shown in FIG. 1.
Figure 5:
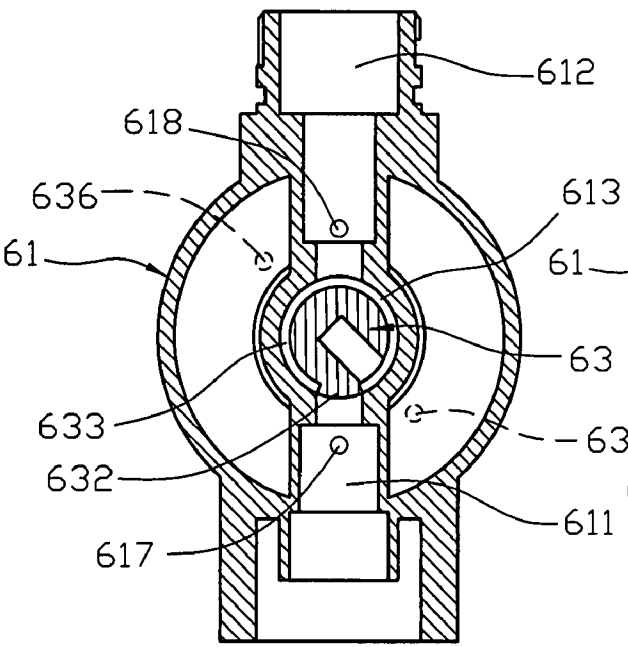
FIG. 5 is a top cross-sectional view of the spraying gun as shown in FIG. 1.
Figure 8:
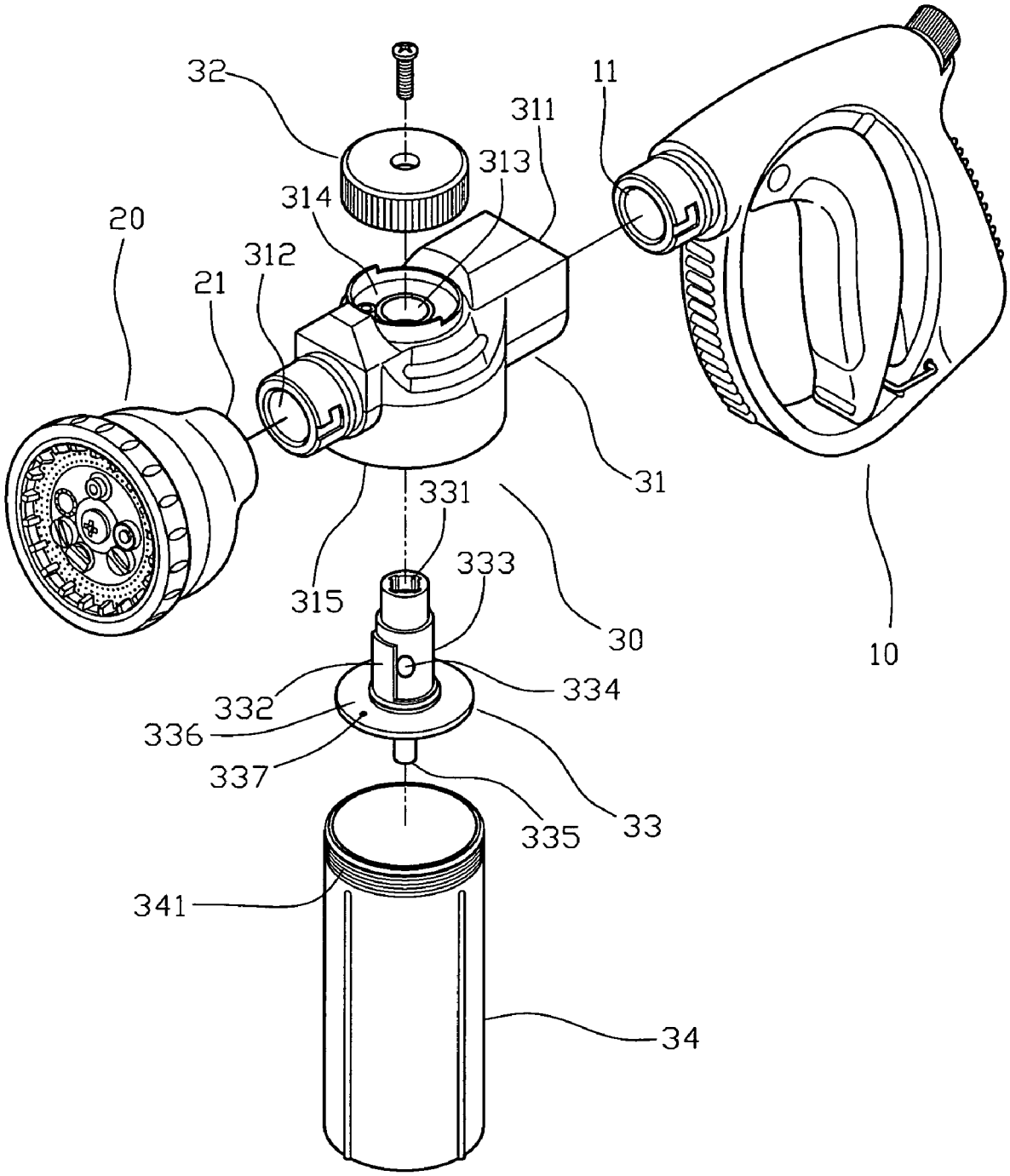
FIG. 8 PRIOR ART
FIG. 8 is an exploded perspective view of a conventional spraying gun in accordance with the prior art.
Figure 9:
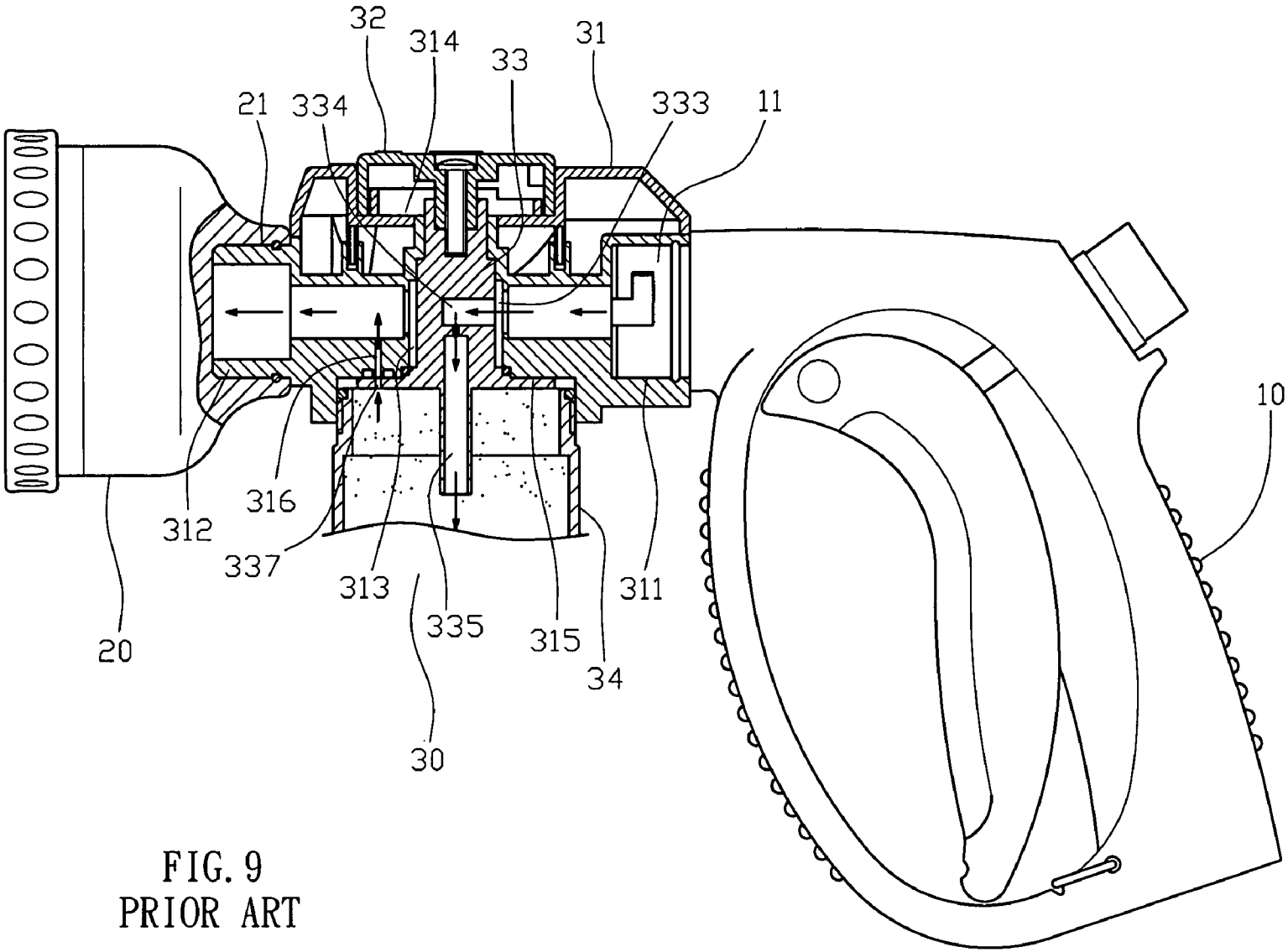
FIG. 9 PRIOR ART
FIG. 9 is a side cross-sectional view of the conventional spraying gun as shown in FIG. 8.

In operation, referring to FIG. 5 with reference to FIGS. 1-4, when the rotation knob 62 is rotated, the adjusting switch 63 is rotatable to a position as shown in FIG. 5 where the seal portion 632 of the adjusting switch 63 aligns with and seal the water inlet hole 611 of the valve body 61 to interrupt the connection between the water inlet hole 611 and the water outlet hole 612 of the valve body 61, so that the water from the water outlet port 41 of the gun body 40 is stopped.

At this time, the inlet flush bore 635 of the adjusting switch 63 is separated from the inlet flush hole 617 of the valve body 61, and the outlet injection bore 636 of the adjusting switch 63 is separated from the outlet injection hole 618 of the valve body 61, so that the water from the water outlet port 41 of the gun body 40 is stopped by the stop disk 634 of the adjusting switch 63 and cannot flow through the water inlet hole 611 of the valve body 61 into the receiving space 641 of the container 64.

Figure 6:
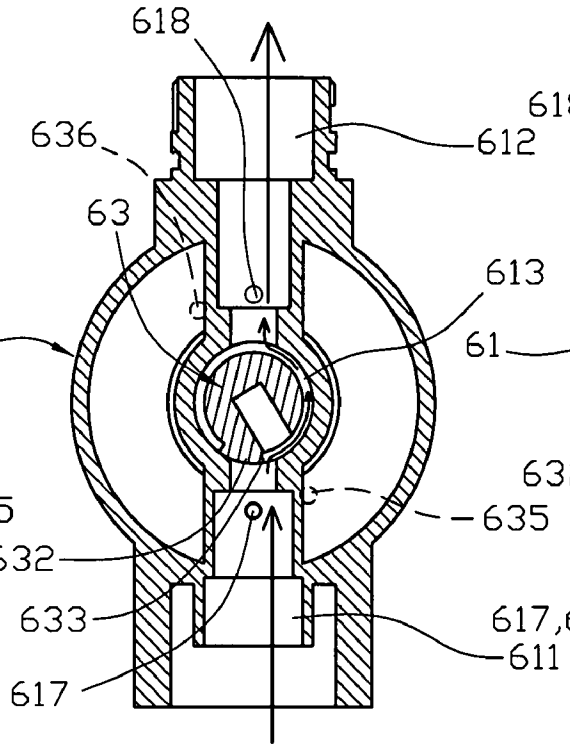
FIG. 6 is a schematic operational view of the spraying gun as shown in FIG. 5.

On the other hand, referring to FIG. 6 with reference to FIGS. 1-4, when the rotation knob 62 is rotated, the adjusting switch 63 is rotatable to a position as shown in FIG. 6 where the conducting portion 633 of the adjusting switch 63 partially aligns with the water inlet hole 611 of the valve body 61 to open the connection between the water inlet hole 611 and the water outlet hole 612 of the valve body 61, so that the water from the water outlet port 41 of the gun body 40 can in turn flow through the water inlet hole 611 of the valve body

61, the conducting portion 633 of the adjusting switch 63, the water outlet hole 612 of the valve body 61 and the water inlet port 51 of the nozzle head 50 into the nozzle head 50. Thus, the water is sprayed outwardly from the nozzle head 50 for use with a user.

At this time, the adjusting switch 63 is rotatable to change the connecting area between the conducting portion 633 of the adjusting switch 63 and the water inlet hole 611 of the valve body 61 to adjust the water flow rate from the gun body 40 into the nozzle head 50.

In addition, the inlet flush bore 635 of the adjusting switch 63 is separated from the inlet flush hole 617 of the valve body 61, and the outlet injection bore 636 of the adjusting switch 63 is separated from the outlet injection hole 618 of the valve body 61, so that the water from the water outlet port 41 of the gun body 40 is stopped by the stop disk 634 of the adjusting switch 63 and cannot flow through the water inlet hole 611 of the valve body 61 into the receiving space 641 of the container 64.

Figure 7:
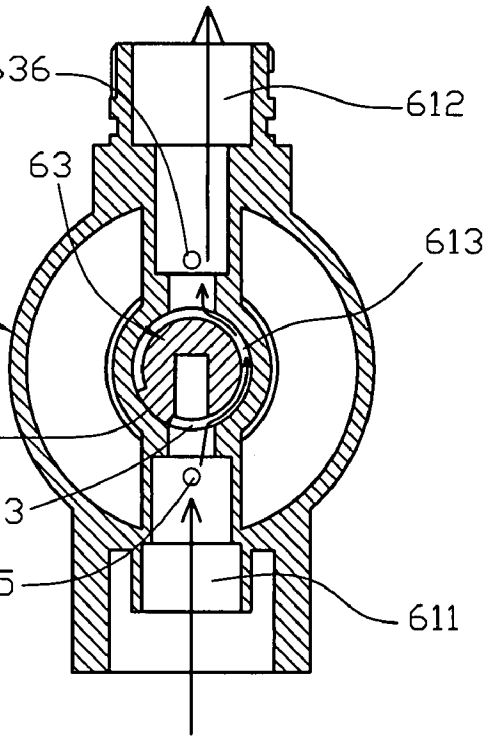
FIG. 7 is a schematic operational view of the spraying gun as shown in FIG. 6.

On the other hand, referring to FIG. 7 with reference to FIGS. 1-4, when the rotation knob 62 is rotated, the adjusting switch 63 is rotatable to a position as shown in FIG. 7 where the conducting portion 633 of the adjusting switch 63 completely aligns with the water inlet hole 611 of the valve body 61 to fully open the connection between the water inlet hole 611 and the water outlet hole 612 of the valve body 61, so that the water from the water outlet port 41 of the gun body 40 can in turn flow through the water inlet hole 611 of the valve body 61, the conducting portion 633 of the adjusting switch 63, the water outlet hole 612 of the valve body 61 and the water inlet port 51 of the nozzle head 50 into the nozzle head 50.

At this time, the inlet flush bore 635 of the adjusting switch 63 aligns with the inlet flush hole 617 of the valve body 61, and the outlet injection bore 636 of the adjusting switch 63 aligns with the outlet injection hole 618 of the valve body 61 as shown in FIG. 7, so that the water from the water inlet hole 611 of the valve body 61 can in turn flow through the inlet flush hole 617 of the valve body 61 and the inlet flush bore 635 of the adjusting switch 63 into the receiving space 641 of the container 64 as shown in FIG. 4 to mix with the detergent contained in the receiving space 641 of the container 64. Then, the water and detergent mixture from the receiving space 641 of the container 64 can in turn flow through the outlet injection bore 636 of the adjusting switch 63, the outlet injection hole 618 of the valve body 61, the water outlet hole 612 of the valve body 61 and the water inlet port 51 of the nozzle head 50 into the nozzle head 50 as shown in FIG. 4. Thus, the water and detergent mixture is sprayed outwardly from the nozzle head 50 for use with the user.

Accordingly, the water is injected through the inlet flush hole 617 of the valve body 61 and the inlet flush bore 635 of the adjusting switch 63 into the receiving space 641 of the container 64 to stir and mix with the detergent, and the water and detergent mixture is injected through the outlet injection bore 636 of the adjusting switch 63 and the outlet injection hole 618 of the valve body 61 into the nozzle head 50, so that the water is mixed with the detergent in the container 64 exactly and completely, thereby enhancing the washing effect of the spraying gun.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A spraying gun, comprising:

a gun body having a water outlet port;

a control valve mounted on the gun body;

a nozzle head mounted on the control valve and having a water inlet port connected to the water outlet port of the gun body via the control valve;

the control valve including a valve body, an adjusting switch, a rotation knob, and a container, wherein:

the valve body of the control valve has a first end formed with a water inlet hole connected to the water outlet port of the gun body, a second end formed with a water outlet hole connected to the water inlet port of the nozzle head and a mediate portion formed with a valve chamber connected between the water inlet hold and the water outlet hole;

the valve body of the control valve has a first side formed with a hollow mounting portion having an inlet flush hole connected to the water inlet hole and an outlet injection hole connected to the water outlet hole;

the adjusting switch of the control valve is rotatably mounted in the valve body and includes a stop disk having an inlet flush bore that is movable to connect to the inlet flush hole of the mounting portion of the valve body and an outlet injection bore that is movable to connect to the outlet injection hold of the mounting portion of the valve body;

the rotation knob of the control valve is rotatably mounted on the valve body and secured to the adjusting switch to rotate the adjusting switch;

the container of the control valve is mounted on the valve body and has an inside formed with a receiving space connected to the inlet flush bore and the outlet injection bore of the adjusting switch;

the valve body of the control valve has a second side formed with a mounting groove connected to the valve chamber, and the rotation knob of the control valve is rotatably mounted in the mounting groove of the valve body;

the rotation knob of the control valve is extended into the mounting groove of the valve body;

the mounting groove of the valve body is located above the valve chamber;

the adjusting switch of the control valve further includes a control stem rotatably mounted in the valve chamber of the valve body and having a first side formed with a protruding seal portion that is movable to interrupt a connection between the water inlet hole and the water outlet hole of the valve body and a second side formed with a recessed conducting portion that is movable to open the connection between the water inlet hole and the water outlet hole of the valve body;

the control stem of the adjusting switch has a first end secured to the stop disk and a second end protruded outwardly from the valve chamber of the valve body and extended into the mounting groove of the valve body;

wherein the mounting groove of the valve body has a substantially cylindrical peripheral wall located above the valve chamber and formed with a recessed limit portion, and the rotation knob of the control valve has a peripheral wall formed with a stop portion that is movable in and limited by the limit portion of the valve body to limit a rotation angle of the adjusting switch relative to the valve body and, wherein the limit portion of the valve body is substantially elongate arc-shaped and extends successively along the cylindrical peripheral wall of the mounting groove of the valve body.

2. The spraying gun in accordance with claim 1, wherein the rotation knob of the control valve is secured to the control stem of the adjusting switch to rotate the adjusting switch.

3. The spraying gun in accordance with claim 1, wherein the rotation knob of the control valve has an inside formed with an outwardly protruding connecting portion inserted into and secured to the second end of the control stem of the adjusting switch.

4. The spraying gun in accordance with claim 1, wherein the adjusting switch is rotatable to a first position where the seal portion of the adjusting switch aligns with and seals the water inlet hole of the valve body to interrupt the connection between the water inlet hole and the water outlet hole of the valve body.

5. The spraying gun in accordance with claim 4, wherein the inlet flush bore of the adjusting switch is separated from the inlet flush hole of the valve body, and the outlet injection bore of the adjusting switch is separated from the outlet injection hole of the valve body when the adjusting switch is rotatable to the first position.

6. The spraying gun in accordance with claim 4, wherein the adjusting switch is rotatable to a second position where the conducting portion of the adjusting switch partially aligns with the water inlet hole of the valve body to open the connection between the water inlet hole and the water outlet hole of the valve body.

7. The spraying gun in accordance with claim 6, wherein the inlet flush bore of the adjusting switch is separated from the inlet flush hole of the valve body, and the outlet injection bore of the adjusting switch is separated from the outlet injection hole of the valve body when the adjusting switch is rotatable to the second position.

8. The spraying gun in accordance with claim 6, wherein the adjusting switch is rotatable to a third position where the conducting portion of the adjusting switch completely aligns with the water inlet hole of the valve body to fully open the connection between the water inlet hole and the water outlet hole of the valve body.

9. The spraying gun in accordance with claim 8, wherein the inlet flush bore of the adjusting switch aligns with the inlet flush hole of the valve body, and the outlet injection bore of the adjusting switch aligns with the outlet injection hole of the valve body when the adjusting switch is rotatable to the third position.

10. The spraying gun in accordance with claim 1, wherein the mounting portion of the valve body is connected to the valve chamber.

11. The spraying gun in accordance with claim 10, wherein the stop disk of the adjusting switch is located between the valve chamber and the mounting portion of the valve body to interrupt a connection between the valve chamber and the mounting portion of the valve body.

12. The spraying gun in accordance with claim 1, wherein the valve chamber of the valve body is located between the inlet flush hole and the outlet injection hole.

13. The spraying gun in accordance with claim 1, wherein each of the inlet flush hole and the outlet injection hole is formed in a peripheral wall of the mounting portion of the valve body.

14. The spraying gun in accordance with claim 1, wherein the seal portion of the adjusting switch is substantially arc-shaped, and the conducting portion of the adjusting switch is substantially arc-shaped.

15. The spraying gun in accordance with claim 1, wherein the container of the control valve has an open top formed with a mounting section mounted in the mounting portion of the valve body.

* * * * *